US006317050B1

(12) United States Patent
Burks

(10) Patent No.: US 6,317,050 B1
(45) Date of Patent: Nov. 13, 2001

(54) WATER ENTRY ALARM SYSTEM

(75) Inventor: Nathaniel W. Burks, San Diego, CA (US)

(73) Assignee: Pool Alarm Corporation, San Diego, CA (US)

( * ) Notice: Subject to any disclaimer, the term of this patent is extended or adjusted under 35 U.S.C. 154(b) by 0 days.

(21) Appl. No.: 09/705,143

(22) Filed: Nov. 2, 2000

(51) Int. Cl.[7] ..... G08B 23/00
(52) U.S. Cl. ..... 340/573.6; 340/604
(58) Field of Search ..... 340/573.6, 573.1, 340/539, 604

(56) References Cited

U.S. PATENT DOCUMENTS

| | | |
|---|---|---|
| 4,549,169 | 10/1985 | Moura et al. . |
| 5,049,859 | 9/1991 | Arnell . |
| 5,091,714 | 2/1992 | de Solminihac . |
| 5,097,254 | 3/1992 | Merrithew . |
| 5,138,300 | 8/1992 | Chance . |
| 5,144,285 | 9/1992 | Gore . |
| 5,274,359 | 12/1993 | Adams . |
| 5,486,814 | 1/1996 | Quinones . |
| 6,157,303 | * 12/2000 | Bodie et al. ..... 340/573.6 |

* cited by examiner

*Primary Examiner*—Edward Lefkowitz
(74) *Attorney, Agent, or Firm*—Brown, Martin, Haller & McClain, LLP

(57) ABSTRACT

A water entry alarm system has at least one harness to be worn about the body of an individual to be protected and carrying a transmitter for transmitting a predetermined signal and a water sensor for turning off the transmitter on detection of water. The harness has a strap for extending about the individual's waist, a first fastener unit at one end of the strap containing a power supply and a second fastener unit at the other end of the strap for releasable connection to the first fastener unit. The transmitter and water sensor are mounted in the second fastener unit, and are connected to the power supply when the first and second fastener units are connected, so that the signal from the transmitter is automatically turned off if the first fastener unit is disconnected from the second fastener unit. The harness is adapted such that it can only be removed from the individual's body by disconnecting the second fastener unit from the first fastener unit, so that the transmitter is automatically switched off on removal of the harness from the individual's body. A remote receiver is adapted to receive the signal transmitted from the transmitter, and activates an alarm unit to produce an audible alarm if the signal from the transmitter is interrupted.

7 Claims, 3 Drawing Sheets

WATER ENTRY ALARM SYSTEM

BACKGROUND OF THE INVENTION

The present invention relates to alarm systems for alerting responsible adults if a child enters a body of water such as a swimming pool or the like.

Swimming pools in the yards of homes or other areas, as well as other bodies of water such as lakes, oceans, and the like, pose a significant risk to non-swimmers, particularly young children who may be unaware of the danger of entering a body of water. In view of this, various alarm systems have been proposed in the past to alert adults in the event that a young child or infant has entered the water. For example U.S. Pat. No. 5,486,814 of Quinones describes a pool guard alarm in which a wrist band carrying a transmitter and a water immersion sensor is worn by children in a pool area. The water immersion sensor is arranged to deactivate the transmitter upon immersion of the device. Whenever the transmission is interrupted, whether due to immersion in water or due to battery failure or the like, a receiver will sense this condition and activate an alarm. One problem with this system is that the wrist band may easily be removed by the child, or accidentally slip off, and the child will then be unprotected.

U.S. Pat. No. 4,549,169 describes another security system in which a portable transmitter is worn about the body of a child being monitored, and an alarm is activated if the signal from the transmitter is not received, for example as a result of the transmitter being submerged in water. The transmitter is worn on a belt around the child's waist. The system includes a series of transmitters and an associated receiver, so that more than one child or individual can be monitored simultaneously. Again, there is nothing to prevent the wearer from removing the belt and transmitter.

SUMMARY OF THE INVENTION

It is an object of the present invention to provide a new and improved water entry alarm system and method.

According to one aspect of the present invention, a water entry alarm system is provided, which comprises at least one harness to be worn about the body of an individual to be protected, the harness having a strap for extending about the individual's waist, the strap having a first end having a first fastener unit and a second end having a second fastener unit for releasable connection to the first fastener unit to secure the strap around the wearer's waist, one of the fastener units having a power source which is a rechargeable battery and the other fastener unit having water sensor for sensing immersion in water and a transmitter connected to the sensor, and having an on condition in which a signal is transmitted and an off condition in which no signal is transmitted, the water sensor switching the transmitter to its off condition on detection of water, and the transmitter being in an off condition when disconnected from the fastener unit containing the power source, the harness being adapted such that it can only be removed from the individual's body by disconnecting the second fastener unit from the first fastener unit, whereby the transmitter is automatically switched off on removal of the harness from the individual's body, a remote receiver for receiving the signal transmitted from the transmitter, and an alarm unit connected to the receiver for activation in the event that the signal from the transmitter is interrupted.

In this system, the alarm is automatically activated if the wearer of the harness enters a body of water, and is also activated if the wearer removes the harness, disconnecting the transmitter from the power source, or if the battery or power source fails or if components fail. In an exemplary embodiment, a plurality of harnesses are provided, each having a transmitter for transmitting a signal of different frequency from the other harnesses, and a corresponding number of receivers are provided, each responsive to a predetermined frequency signal from a particular harness. The alarm unit is connected to all of the receivers for producing an alarm if any one of the receivers does not receive its respective signal. In this way, a number of individuals, such as children at a pool party, can be monitored at once. Additionally, each receiver will have a visual alarm condition indicator, such as a light which is switched on or off if the signal for that receiver is lost. Thus, an adult can readily determine which of the transmitter signals has turned off when an alarm is heard, and look for the child wearing the harness associated with that particular transmitter.

In one exemplary embodiment of the invention, the harness has a waist strap with opposite ends carrying the first and second fastener units, a pair of shoulder straps secured between opposing portions of the waist strap for extending over the wearer's shoulders, and an auxiliary strap having a first end secured to the waist strap at a position opposite the fastener units, and a second end, a connector unit secured to the second end of the auxiliary strap, the connector unit having a first fastener for releasable connection to the first fastener unit, a second fastener for releasable connection to the second fastener unit, and a conductive linkage between the first and second fastener, whereby the first and second fastener units are mechanically connected via the connector unit and the power source and transmitter are electrically connected through the conductive linkage in the connector unit. The auxiliary strap is adapted to extend downwardly from the waist strap on one side of the wearer's body, down between the individual's legs, and back up on the opposite side of the wearer's body for connection in series between the two fastener units. This arrangement makes it impossible for the harness to be removed either deliberately or accidentally without detaching the fastener units from the connector unit, thereby shutting off power to the transmitter and causing the alarm to activate.

According to another aspect of the present invention, a water entry alarm method is provided which comprises the steps of securing a harness about the body of an individual to be protected by securing a first fastener unit on the harness to a second fastener unit on the harness, thereby connecting a power source in the first fastener unit to a transmitter in the second fastener unit so that the transmitter emits a predetermined signal, connecting the transmitter to a water sensor in the second fastener unit so that the transmitter is switched off on detection of water by the water sensor, providing a remote receiver unit for detecting the signal emitted by the transmitter, and connecting the receiver unit to an alarm unit for emitting an alarm in the event that the signal from the transmitter is lost, whereby an alarm is activated automatically if an individual wearing the harness enters a body of water, if the harness is removed from the individual by disconnecting the first fastener unit from the second fastener unit, or if the power source fails.

The water entry alarm system and method of this invention is therefore an improvement over previous systems which would not necessarily activate an alarm if the transmitter was removed from about the body of the individual to be protected, either deliberately or accidentally. In this invention, the harness carrying the transmitter can only be removed if the transmitter is disconnected from its power source, which will also activate the alarm.

DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 5:
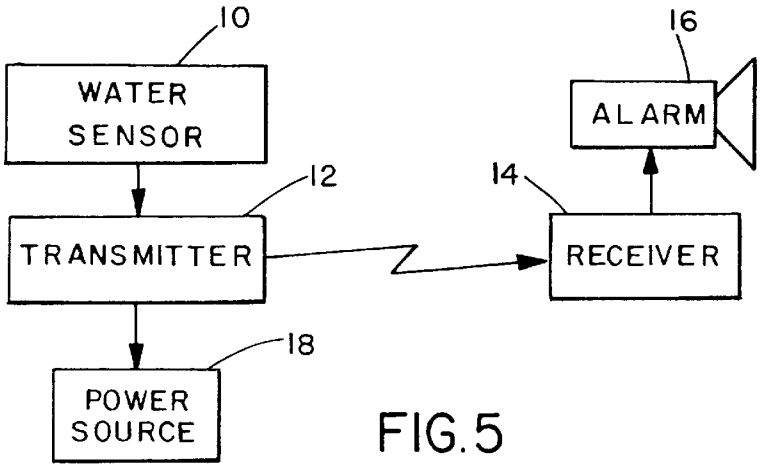
FIG. 5 is a diagram of the system.

FIGS. 1 to 6 illustrate a water entry alarm system according to an exemplary embodiment of the present invention. As schematically illustrated in FIG. 5, the system basically comprises a water sensor 10 connected to a transmitter 12 for transmitting a predetermined radio frequency signal, a receiver 14 for receiving the signal from transmitter 12, and an alarm unit 16 which is activated to produce an audible alarm if the signal from transmitter 12 is lost. The system is arranged such that the transmitter 12 will normally emit a signal when properly connected to power source 18, such as a rechargeable battery, but is switched off in the event that water sensor 10 detects the presence of water.

Figure 1:
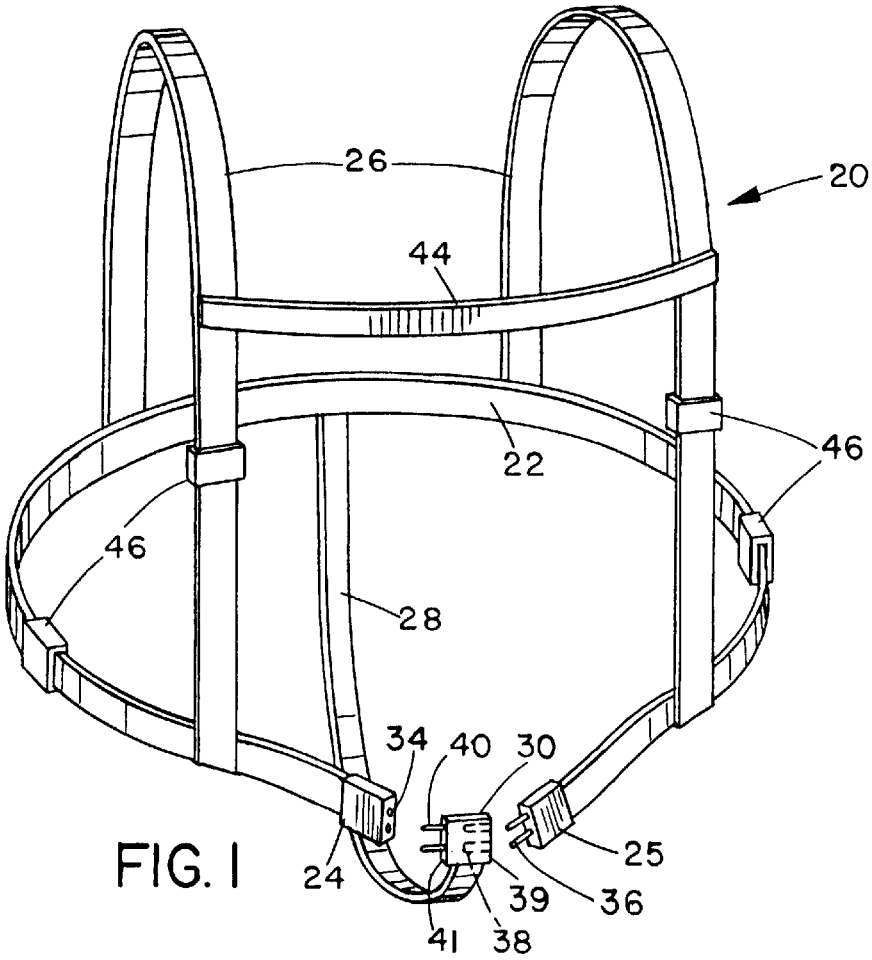
FIG. 1 is a perspective view of the harness of a water entry alarm system according to an exemplary embodiment of the invention, with the plug units disconnected.
Figure 2:
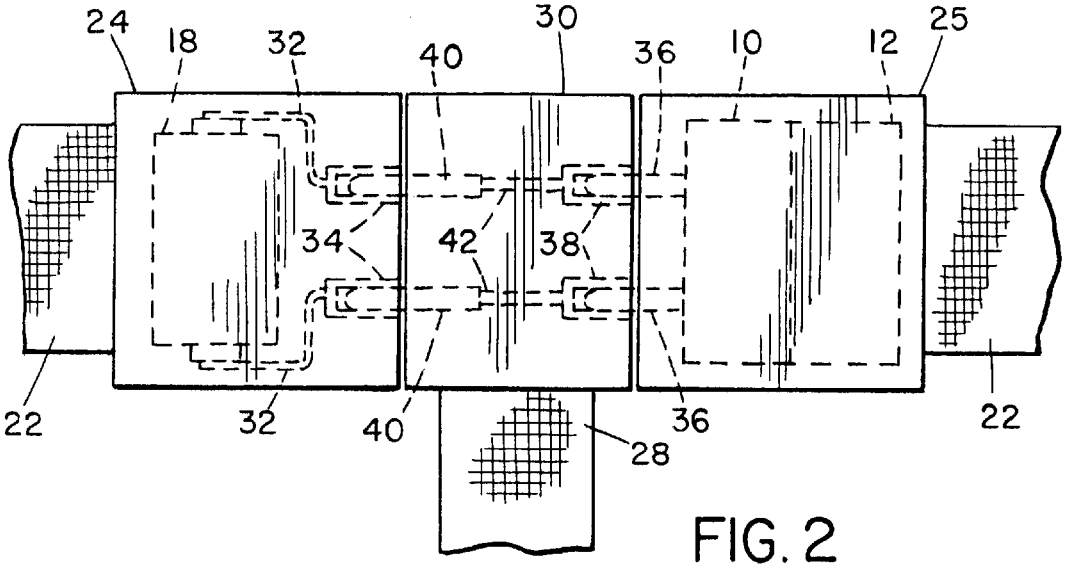
FIG. 2 is an enlarged view showing the plug units connected in the operating position.
Figure 6:
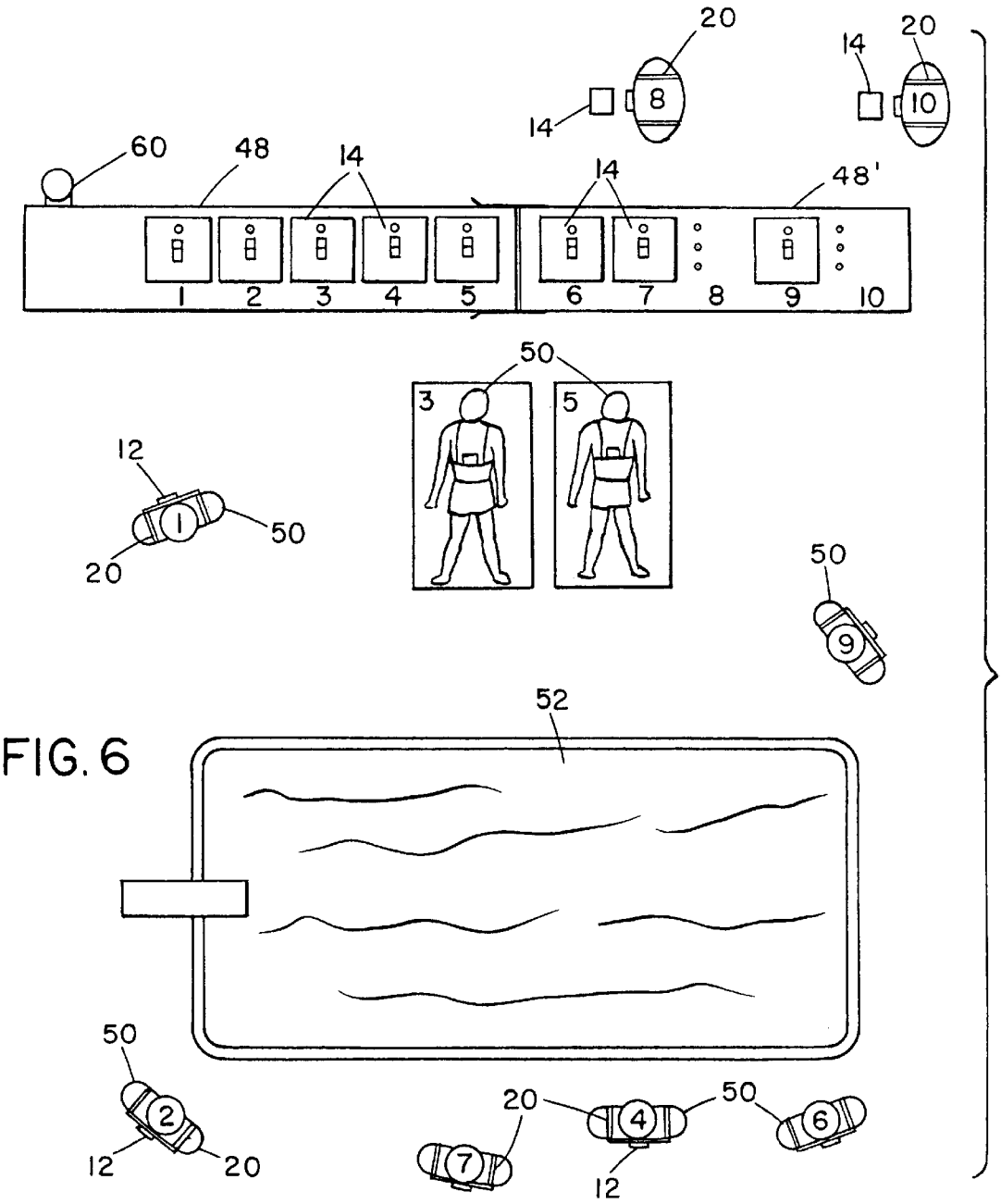
FIG. 6 is a diagram of a pool area with a number of transmitter and receiver pairs operational.

In the exemplary embodiment, the transmitter 12, water sensor 10, and power source 18, are all mounted in a harness 20, as best illustrated in FIGS. 1 and 2. The harness 20 includes a first, waist strap 22 for securing around a wearer's waist, having a first plug or fastener unit 24 at one end and a second plug or fastener unit 25 at the opposite end. A pair of shoulder straps 26 are each secured at opposite ends to opposing portions of the waist strap 22 for extending over a wearer's shoulders, as indicated in FIG. 6. An auxiliary strap 28 is secured to the waist strap 22 opposite the plug units at one end, and has an interconnector plug unit 30 secured at its opposite end. The interconnector plug unit is designed for connection between the plug units 24 and 25 as indicated in FIG. 2.

The power source or battery 18 is mounted in the first plug unit 24, and has positive and negative leads 32 connected to a pair of sockets 34 on the end face of plug unit 24, as best illustrated in FIG. 2. The transmitter 12 and water sensor 10 are both mounted in the second plug unit 25, and are connected to conductive pins 36 projecting from the end face of plug unit 25. The interconnector unit or adapter 30 has a pair of conductive sockets 38 on one end face 39, a pair of conductive pins 40 on the opposite end face 41, and a pair of conductive leads 42 extending through the unit, each lead 42 connecting a respective one of the pins to a corresponding socket. Pins 40 are adapted for engagement in sockets 34 of the first plug unit 24, while sockets 38 are adapted to receive the pins 36 projecting from plug unit 25, thereby mechanically and electrically connecting the first plug unit 24 to the second plug unit 25, as illustrated in FIG. 2.

The harness also includes a connector strap 44 connecting the two shoulder straps 26 on one side of the wearer's body. The waist strap 22 and shoulder straps 26 are each adjustable in length via conventional length adjuster devices 46. The harness is designed to be worn about the body of an individual to be protected when in the vicinity of a body of water. The harness is first pulled down over the individual's head with the shoulder strap engaging the wearer's shoulder at each side, with the straps 22 and 28 unfastened. The intermediate strap 28 is then passed from one side of the wearer's body, such as the front, between the wearer's legs and up the other side of the wearer's body, such as the back, so that the interconnector plug unit 30 is positioned between plug units 24,25 on opposite ends of the waist strap 22. The pins 40 on interconnector unit 30 are then inserted in sockets 34, while pins 36 on the plug unit 25 are inserted in sockets 38 in the interconnector unit, as in FIG. 2. At this point, the harness is secure and cannot be removed without unfastening the plug units 24 and 25 from the interconnector unit 30. The harness cannot accidentally slip off, since the shoulder straps 26 and auxiliary strap 28 will prevent this from happening. The shoulder straps 26 also cannot accidentally slip down over the shoulders, since they are secured together by strap 44.

Figure 3:
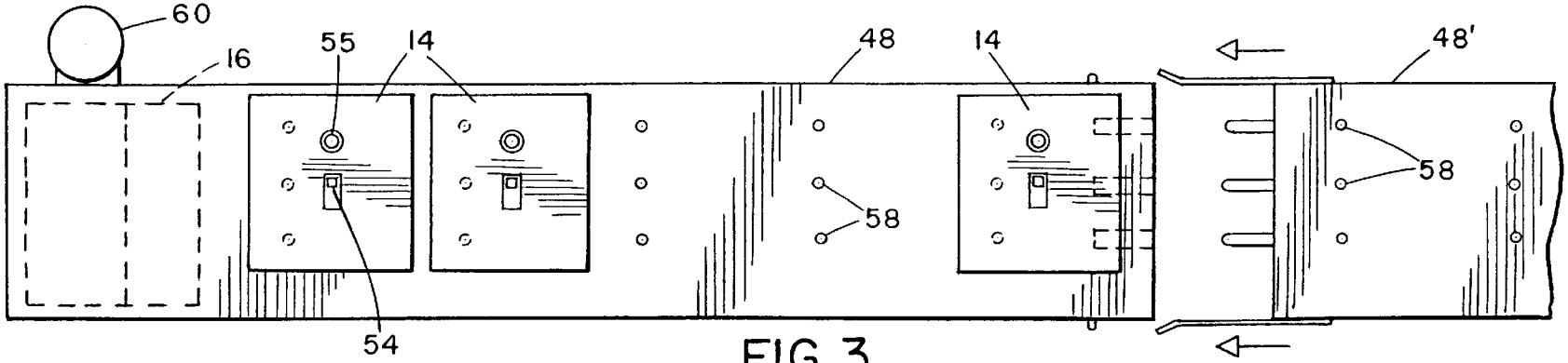
FIG. 3 is a front view of the receiver base unit of the system.
Figure 4:
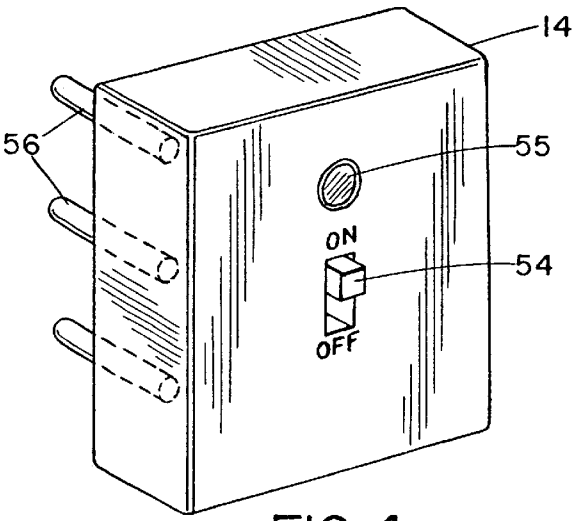
FIG. 4 is a perspective view of one receiver.

FIGS. 3 and 6 illustrate a base unit 48 and a supplemental base unit 48'for receiving a plurality of receivers 14 for receiving signals from a plurality of transmitters 12, one of which is illustrated in more detail in FIG. 4. This will permit a number of individuals 50 such as children to be monitored simultaneously, with each child wearing a harness 20 carrying one of the transmitters 12, as indicated in FIG. 6. This will permit adults to monitor the children 50 while they are in the vicinity of a pool 52 or other body of water.

Each transmitter 12 transmits a predetermined frequency signal which is different from the frequencies of the other transmitters, and is associated with a respective receiver 14 for detecting that specific frequency. As illustrated in FIG. 4, each receiver 14 has an on/off switch 54 and an indicator light 55 which will be on whenever the receiver is plugged into the base unit 48 or attached base unit 48' and receiving a signal from its associated transmitter 12. The receiver 14 has contact pins 56 projecting from its lower face, which are connected to associated receiver circuitry within the unit 14.

The base unit 48 comprises an elongate, rectangular outer housing having a series of spaced sets of sockets 58 on its upper face, with each set of sockets being arranged to receive the pins 56 of a respective receiver 14. The base unit 48 contains a power source for the attached receivers 14 as well as the alarm unit 16, which generates an audible alarm as well as illuminating an alarm light 60. A suitable switching device, such as a relay, controls connection of the power source to the alarm unit in order to activate the alarm. The main base unit 48 can seat a plurality of receivers 14, up to five receivers in the illustrated embodiment, and can be connected in series to supplemental base units 48' if necessary to accommodate additional receivers 14, where more than five individuals are to be monitored.

FIG. 6 illustrates a main base unit 48 for holding five receivers 14, labeled 1 to 5, and a supplemental base unit 48' connected to unit 48 for holding an additional five receivers 14, labeled 6 to 10. Receivers are mounted in each of the sets of sockets 1 to 5 of the main base unit 48, and in sockets 6,7 and 9 of the supplemental base unit 48', with sockets 8 and 10 being unused. The transmitter harnesses 20 corresponding to receivers 1 to 7 and 9 are secured on eight children 50, labeled 1 to 7 and 9 respectively, and the transmitters 12 on the harnesses are turned on, along with the corresponding receivers. The "on"lights of the receivers which are active will all be lit. Harnesses with transmitters 8 and 10, and the associated receivers, are not in use and are all turned off, but can be readily activated as needed.

Figure 7:
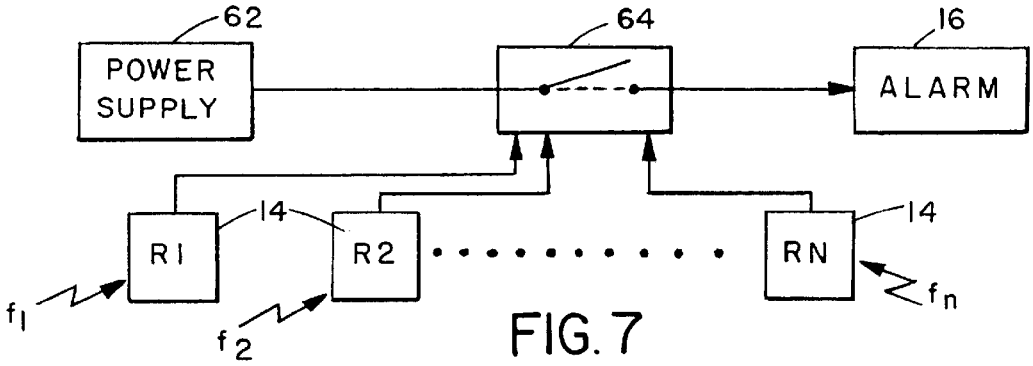
FIG. 7 is a schematic block diagram of the base unit.

FIG. 7 is a schematic block diagram of the base unit 48. As illustrated, a power supply 62 is connected via a normally open relay or switching unit 64 to the alarm unit. A plurality of receiver units R1 to RN are mounted in the base unit and are designed to receive signals f1 to fN of different respective frequencies. Each receiver unit has a control output connected to the switching unit 64, such that if the unit no longer receives its associated frequency signal, it will activate the switching unit to close the switch and connect the alarm unit 16 to the power supply. This turns on a loud audible alarm and also lights up the alarm light 60 on the base unit. Signal lights may also be provided on each of the receiver units which are designed to light up to indicate which particular receiver unit is no longer receiving a signal.

If any of the sensors associated with the worn harnesses 1 to 7 or 9 becomes wet, for example the sensor of harness 3, as a result of the child wearing the harness entering the water, the transmitter associated with that harness will be turned off. The receiver R3 which is set to receive the signal from transmitter 3 will produce a control output to close relay or switching unit 64 and connect the power supply to the alarm unit. The alarm will then sound, and the alarm light will be lit. The alarm will stay active until someone turns the associated receiver off. The system can be reset only after the child is removed from the water, the sensor is completely dried off, and the transmitter and receiver are restarted.

The alarm will also be activated if a harness is removed from a child without first turning off and removing the associated receiver from the base unit. As discussed above, the harness is designed such that it is impossible for it to slip off or be removed without disconnecting the plug units and interconnector unit. Strap 28 prevents the harness from being pulled up over the child's head. Shoulder straps 26 prevent the harness from being pulled downwardly over the child's feet, and strap 44 prevents the shoulder straps from slipping down over the child's arms. Thus, removal of the harness necessarily involves disconnecting the plug units, and thus cutting off the power supply to the transmitter 12. This will cause the alarm to sound unless the associated receiver is first turned off and removed from the base unit, which will only by done if the child is leaving the pool area.

The alarm will also be activated if there is any interruption in power to any of the currently active transmitters, such that the associated signal is no longer transmitted. Also, an interruption in power supply to the base unit will cause the alarm to sound as well. Essentially, this system will cause a loud alarm to sound in the event that any monitored child enters a body of water, and also if there is any malfunction in any of the transmitters or receivers, or any loss of power to any unit in the system. This produces a much safer and more reliable system for monitoring children in the vicinity of pools or the like.

Although an exemplary embodiment of the invention has been described above by way of example only, it will be understood by those skilled in the field that modifications may be made to the disclosed embodiment without departing from the scope of the invention, which is defined by the appended claims.

I claim:

1. A water entry alarm system, comprising:

at least one harness to be worn about the body of an individual to be protected, the harness having at least one strap for extending about the individual's body, the strap having a first end having a first fastener unit and a second end having a second fastener unit for releasable connection to the first fastener unit;

a power supply mounted in the first fastener unit;

a water sensor and a transmitter mounted in the second fastener unit, the sensor having a control output and the transmitter being connected to the sensor output, the transmitter having an on condition in which a signal is transmitted and an off condition in which no signal is transmitted, the water sensor control output switching the transmitter to its off condition on detection of water;

the power supply being electrically connected to the transmitter when the fastener units are connected together, and the transmitter being in an off condition when disconnected from the first fastener unit and power supply;

the harness being adapted such that it can only be removed from the individual's body by disconnecting the second fastener unit from the first fastener unit, whereby the transmitter is automatically switched off on removal of the harness from the individual's body;

a remote receiver for receiving the signal transmitted from the transmitter; and an alarm unit connected to the receiver for activation in the event that the signal from the transmitter is interrupted.

2. The system as claimed in claim 1, including a plurality of harnesses, each harness having a transmitter for transmitting a signal of different frequency from the other harnesses, and a corresponding number of receivers, each receiver being responsive to a predetermined frequency signal from a respective one of the harness transmitters, the alarm unit being connected to all of the receivers for producing an alarm if any one of the receivers does not receive its respective signal.

3. The system as claimed in claim 1, wherein the alarm unit comprises an audible alarm generator and an alarm light.

4. The system as claimed in claim 1, wherein the strap comprises a waist strap for extending about the wearer's waist, the harness further comprising a pair of shoulder straps secured between opposing portions of the waist strap for extending over the wearers shoulders.

5. The system as claimed in claim 4, wherein the harness further comprises an auxiliary strap having a first end secured to the waist strap at a position opposite the fastener units, and a second end, a connector unit secured to the second end of the auxiliary strap for releasably connecting the first fastener unit to the second fastener unit, the connector unit having a first fastener for releasable connection to the first fastener unit, a second fastener for releasable connection to the second fastener unit, and a conductive linkage for electrically connecting the power supply in the first fastener unit to the transmitter in the second fastener unit, whereby the first and second fastener units are mechanically connected via the connector unit and the power source and transmitter are electrically connected through the conductive linkage in the connector unit, and the auxiliary strap is adapted to extend downwardly from the waist strap on one side of the wearer's body, down between the individual's legs, and back up on the opposite side of the wearers body for connection in series between the two fastener units.

6. The system as claimed in claim 4, including a connecting strap extending between the shoulder straps for preventing the shoulder straps from slipping down from the wearer's shoulders.

7. A water entry alarm method, comprising the steps of:

securing a harness about the body of an individual to be protected by securing a first fastener unit on the harness to a second fastener unit on the harness and connecting a power supply in the first fastener unit to a transmitter in the second fastener unit so that the transmitter emits a predetermined signal;

connecting the transmitter to a water sensor in the second fastener unit so that the transmitter is switched off on detection of water by the water sensor;

providing a remote receiver unit for detecting the signal emitted by the transmitter; and connecting the receiver unit to activate an alarm unit for emitting an alarm in the event that the signal from the transmitter is lost, whereby an alarm is activated automatically if any one of a series of events occurs, the events comprising an individual wearing the harness entering a body of water so that the water sensor is activated, the harness being removed from the individual by disconnecting the first fastener unit from the second fastener unit without turning off the transmitter and associated receiver unit, and failure of the power supply.

* * * * *